US006071553A

United States Patent [19]

Ferne et al.

[11] Patent Number: 6,071,553

[45] Date of Patent: Jun. 6, 2000

[54] METHOD FOR PRODUCING MELT-BONDING WIRES

[75] Inventors: Maurice Ferne; Rolf Nagel, both of Bramsche, Germany; Pierre Yves Le Tiec, Tergnier, France

[73] Assignee: Alcatel, Paris, France

[21] Appl. No.: 08/901,356

[22] Filed: Jul. 28, 1997

[30] Foreign Application Priority Data

Aug. 2, 1996 [DE] Germany ..... 196 31 298
Jun. 2, 1997 [EP] European Pat. Off. ..... 97401218

[51] Int. Cl.[7] ..... B05D 1/18; B05D 5/12

[52] U.S. Cl. ..... 427/120; 427/8; 427/434.6

[58] Field of Search ..... 427/117, 118, 427/120, 9, 10, 434.6, 8

[56] References Cited

U.S. PATENT DOCUMENTS

| | | | |
|---|---|---|---|
| 4,070,503 | 1/1978 | Robert et al. . | |
| 4,073,788 | 2/1978 | Peterson | 427/120 |
| 4,102,300 | 7/1978 | Robert et al. . | |
| 4,145,474 | 3/1979 | Kertscher et al. | 427/120 |
| 4,394,417 | 7/1983 | Hilker . | |
| 4,402,789 | 9/1983 | Vexler | 427/120 |
| 4,474,825 | 10/1984 | Schmidt | 427/10 |
| 4,537,804 | 8/1985 | Keane et al. | 427/118 |
| 4,918,260 | 4/1990 | Griffith et al. | 427/120 |
| 5,431,954 | 7/1995 | Inazawa et al. | 427/117 |

FOREIGN PATENT DOCUMENTS

| | | |
|---|---|---|
| 0 009 312 A1 | 4/1980 | European Pat. Off. . |
| 0 488 999 B1 | 8/1995 | European Pat. Off. . |
| 2 357 041 | 6/1997 | France . |
| 62-232802 | 10/1987 | Japan . |
| 1 263 022 | 2/1972 | United Kingdom . |

OTHER PUBLICATIONS

Patent Abstracts of Japan, Publication No. JP1313807, Publication Date: Dec. 19, 1989, vol. 14, No. 117.

"Insulating Materials for Design and Engineering Practice", by Frank M. Clark, Chapter XIV, pp. 766–770 1962. Wiley & Sons.

*Primary Examiner*—Shrive P. Beck
*Assistant Examiner*—Bret Chen
*Attorney, Agent, or Firm*—Ware, Fressola, Van der Sluys & Adolphson LLP

[57] ABSTRACT

In a method for the production of melt-bonding wires to enable the use of non-solvent-containing thermoplastic or thermosetting coating materials, meltable thermoplastic or thermosetting materials are supplied to a fusion chamber (8) where they are melted. The insulated electrical conductor (1) to be coated is drawn through the melt and after the coating process leaves the coating chamber (12) through a calibration device (5), which is followed by cooling.

9 Claims, 5 Drawing Sheets

METHOD FOR PRODUCING MELT-BONDING WIRES

BACKGROUND OF THE INVENTION

1. Technical Field

The invention concerns a method of producing melt-bonding wires containing at least one electrical conductor, wherein the at least one electrical conductor is provided with a layer of insulation covered by a meltable bonding layer, a device for producing melt-bonding wires containing at least one electrical conductor with a layer of insulation covered by a meltable bonding layer with a coating device for applying the bonding layer, as well as a melt-bonding wire with at least one electrical conductor surrounded by a layer of insulation covered by a meltable bonding layer.

2. Description of the Prior Art

Known melt-bonding wires have an electrical conductor with an electric insulation made of an insulating lacquer, which is provided with an additional bonding layer of a solvent-containing bonding lacquer. By means of this bonding layer, windings of melt-bonding wires bond after being sufficiently heated, for example by means of a pulsed current, by melting the bonding layers of the neighboring wire windings into a solid bonded connection.

Usually the bonding layer is produced by repeatedly applying and burning-in solvent-containing layers of lacquer. Depending on the viscosity of the lacquer needed for the coating process, liquid meltable bonding lacquers containing 65% to 90% of solvents are used for that purpose and therefore only contain 10 to 35% of solids. The burning-in of the bonding layer takes place in a separate oven, so that in addition to the oven required to burn-in the insulation lacquer, another oven is needed for burning-in the bonding lacquer. In both ovens, the film of insulating lacquer or the covering film of bonding lacquer are hardened by the effect of temperature which removes most of the solvents contained in the layers of lacquer. The released solvent vapors are routed to downstream catalyzers where they are burned.

The solvents contained in the lacquers being used are toxic as a rule, they produce intensive odors and are caustic. This applies in particular to the bonding lacquers containing 65% to 90% of solvents. The solvents being used are cresol, xylenol, NMP solvent, butanol and others. They form explosive mixtures during evaporation which must be controlled with a correspondingly expensive technology. In addition the solvents, which are unavoidably emitted by the lacquers used to apply the insulation and bonding layers, pollute the atmosphere and require costly ventilation equipment. Furthermore the vapors released into the atmosphere after the catalytic burnout contain residual amounts of toxic substances. Beyond that, residual amounts of solvents are released when the windings made of the known melt-bonding wires are heated, particularly when the windings are heated by means of pulsed currents to melt the bonding layers of neighboring wire windings.

SUMMARY OF THE INVENTION

It is an object of the present invention to significantly reduce or entirely avoid the use of solvents in as simple a way as possible when producing the meltable bonding layer of melt-bonding wires.

This problem is solved by the invention in that meltable thermoplastic or thermosetting material is supplied to and melted in a fusion chamber. The at least one electrical conductor provided with a layer of insulation is drawn through the melted thermoplastic or thermosetting material, where it is provided with a bonding layer. The melt-bonding wire is calibrated and subsequently cooled. The coating device has a fusion chamber for melting thermoplastic or thermosetting material, an inlet opening for the at least one electrical conductor, a coating chamber containing melted thermoplastic or thermosetting material where a bonding layer of thermoplastic or thermosetting material is applied in the melted condition, and a calibration device on the outlet side for the melt-bonding wire.

The method of the invention and the use of the device of the invention permit insulated electrical conductors to be coated in a simple manner without the use of solvents by applying meltable thermoplastic or thermosetting material. By passing through the melted thermoplastic or thermosetting material with subsequent calibration, a high quality of the meltable bonding layer which corresponds to the quality requirements of the international norms can be achieved, even when using non-solvent-containing thermoplastic materials, for example polyamide 11, or non-solvent-containing thermosetting materials. Any subsequent burning-in of the bonding layer is not required. The application of the bonding layer can take place under atmospheric pressure. After application of the bonding layer and the calibration, the melt-bonding wires only require to be cooled to room temperature and in the finished condition offer a high degree of concentricity, a smooth surface and good homogeneity.

The invention enables a particularly cost-effective production of melt-bonding wires with a favorable and effective use of materials, since no expensive bonding lacquers are required which contain large amounts of solvents that are only needed to apply the bonding layer. In addition, when the bonding layer is applied in accordance with the invention, the working areas are not polluted since no solvent vapors are released. The device of the invention consumes less power and has an essentially simpler and more cost-effective design than the device constructed in the conventional manner, since no second oven is required for burning-in the bonding layer and evaporate the solvents, no downstream catalyzer is needed to burn out the solvent vapors and no expensive installations are required for the multi-layer application of bonding lacquers. An already existing installation for producing lacquered wire can therefore be upgraded at no great expense into an installation for producing melt-bonding wires in accordance with the invention. Even a possible production of the bonding layer by extruding a suitable plastic is more expensive.

Furthermore no solvents are released from the bonding layers when melt-bonding wires are processed according to the invention or are produced into windings according to the invention, and when the bonding layers are melted to cement the neighboring wire windings of the melt-bonding wires into a bonded connection. The windings can also be used without danger in devices that make the highest demands on safety-related specifications, for example devices for medical purposes, since the melt-bonding wires contain no residues of solvents.

The invention will be fully understood when reference is made to the following detailed description taken in conjunction with the accompanying drawings.

DETAILED DESCRIPTION OF THE INVENTION

Figure 1:
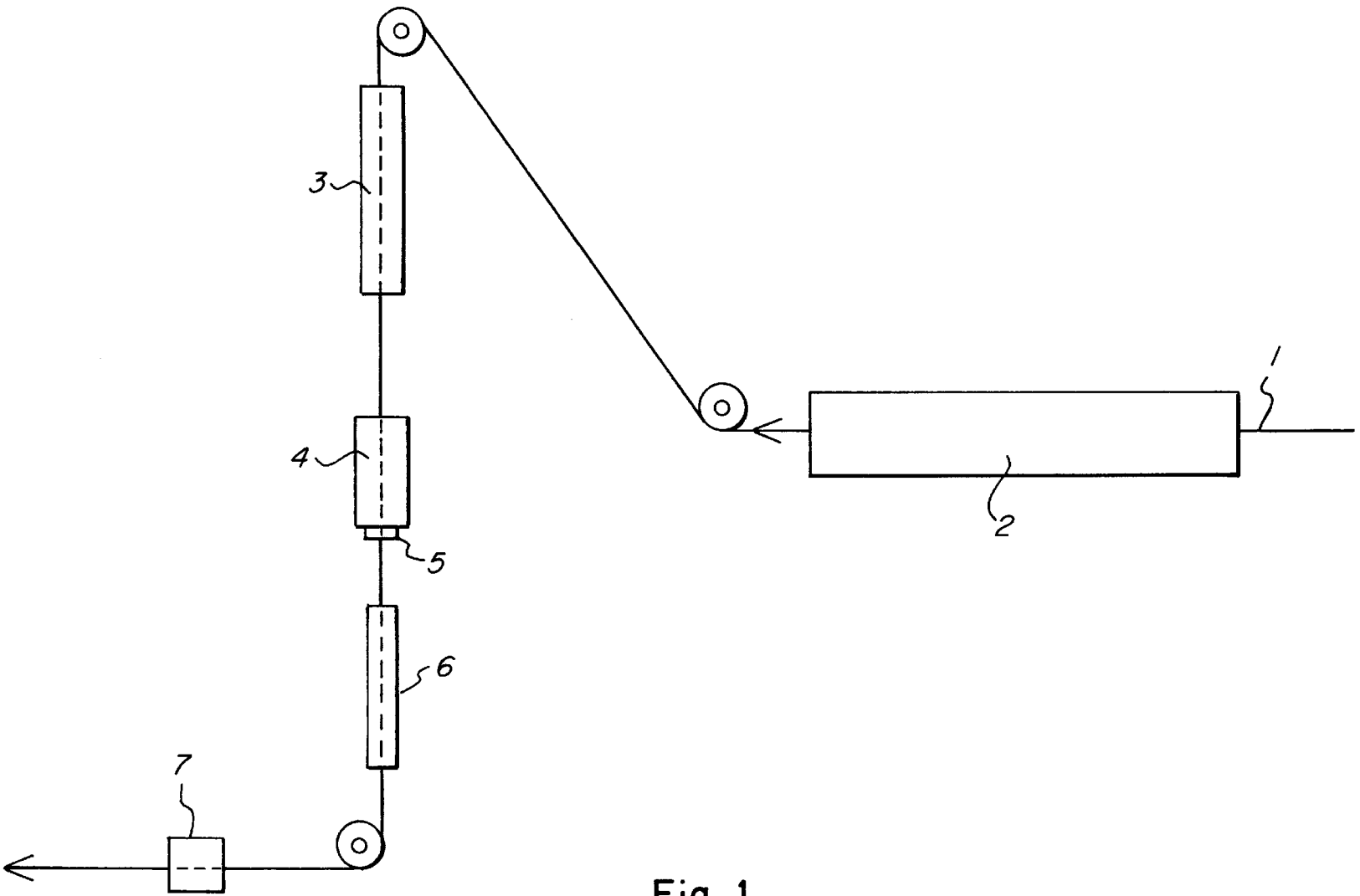
FIG. 1 is a basic block diagram of a device for producing melt-bonding wires.

In the figures, 1 designates an electrical conductor or wire to be coated, which is taken from a not illustrated supply spool and is first routed to a lacquering device 2 where an insulating lacquer (this also can be a varnish or enamel) is applied. To produce a melt-bonding wire containing several twisted or parallel electrical conductors 1, for example, a corresponding number of lacquering devices arranged in parallel is provided, or electrical conductors which are already equipped with a layer of insulation are taken from supply spools.

After it leaves the lacquering device 2, the electrical conductor 1 which is now equipped with an insulating layer passes through a heating chamber 3 for heating the conductor. As an alternative, depending on temperature conditions or the coating material to be applied, the insulated electrical conductor 1 can pass through a cooling chamber for cooling. Subsequently the insulated electrical conductor 1, which is brought to the necessary process temperature by heating or cooling, is routed to a coating device 4 containing a calibration device 5 on the outlet side, for applying a meltable bonding layer as illustrated in detail in FIGS. 2 to 4.

The calibration device 5 used to calibrate the melt-bonding wire with the bonding layer can be built like a conventional lacquering nozzle. The calibration can take place by supplying heat e.g. to a heatable calibration device 5. A cooling device 6 can follow the calibration device 5 for faster cooling of the finished melt-bonding wire. The melt-bonding wire is cooled to the approximate ambient temperature e.g. by injecting cold pressurized air into a cooling pipe, in order to avoid heating the idler pulleys with the resulting danger of hardening the bonding layer of the melt-bonding wire to the surface of the wire-guiding groove of an idler pulley. After cooling, the melt-bonding wire is provided with conventional lubricating means for example in an application device 7, and is wound onto a not illustrated take-up unit.

Figure 2:
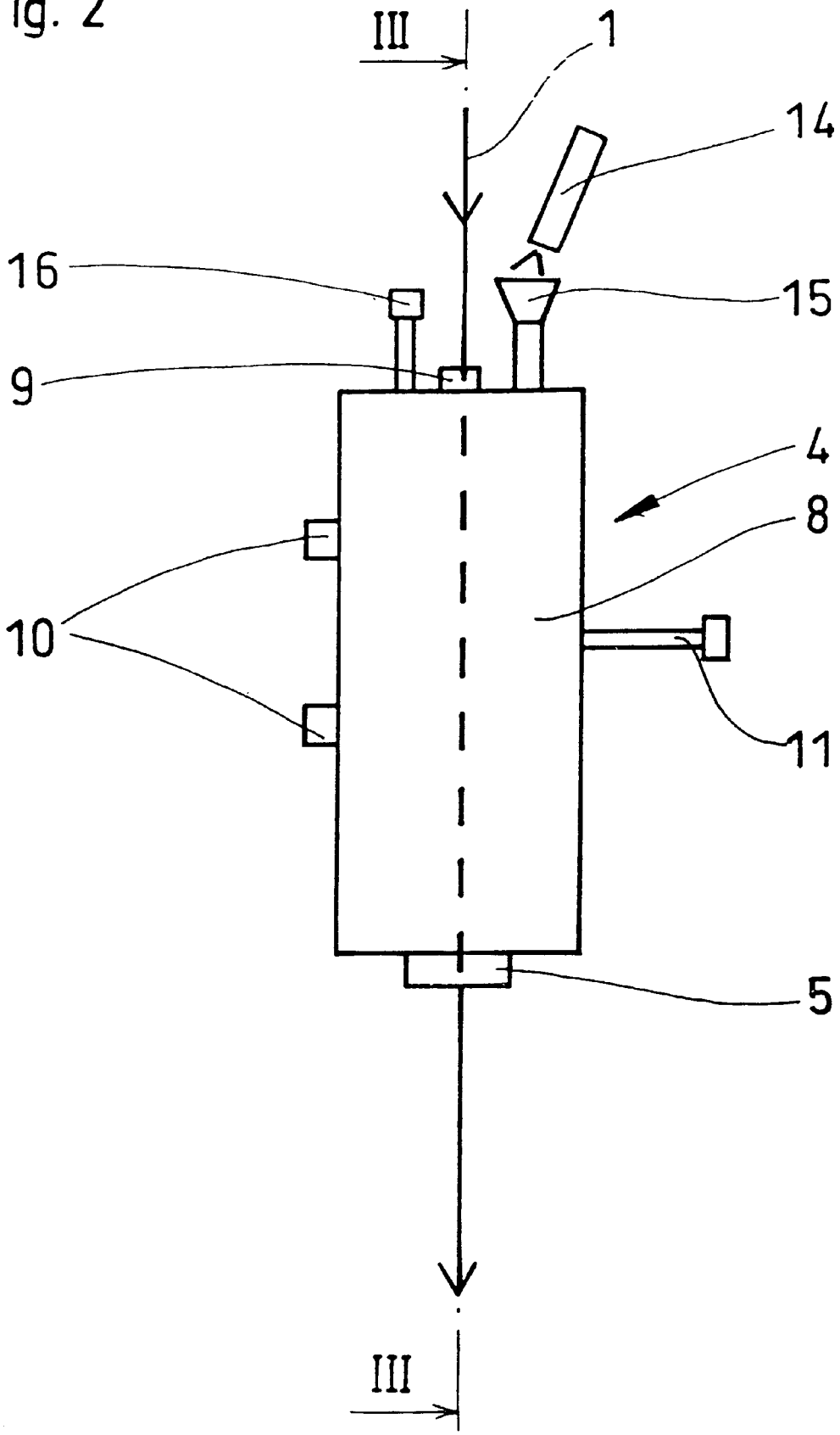
FIG. 2 is a schematic illustration of a first configuration example of a coating device according to the invention.
Figure 3:
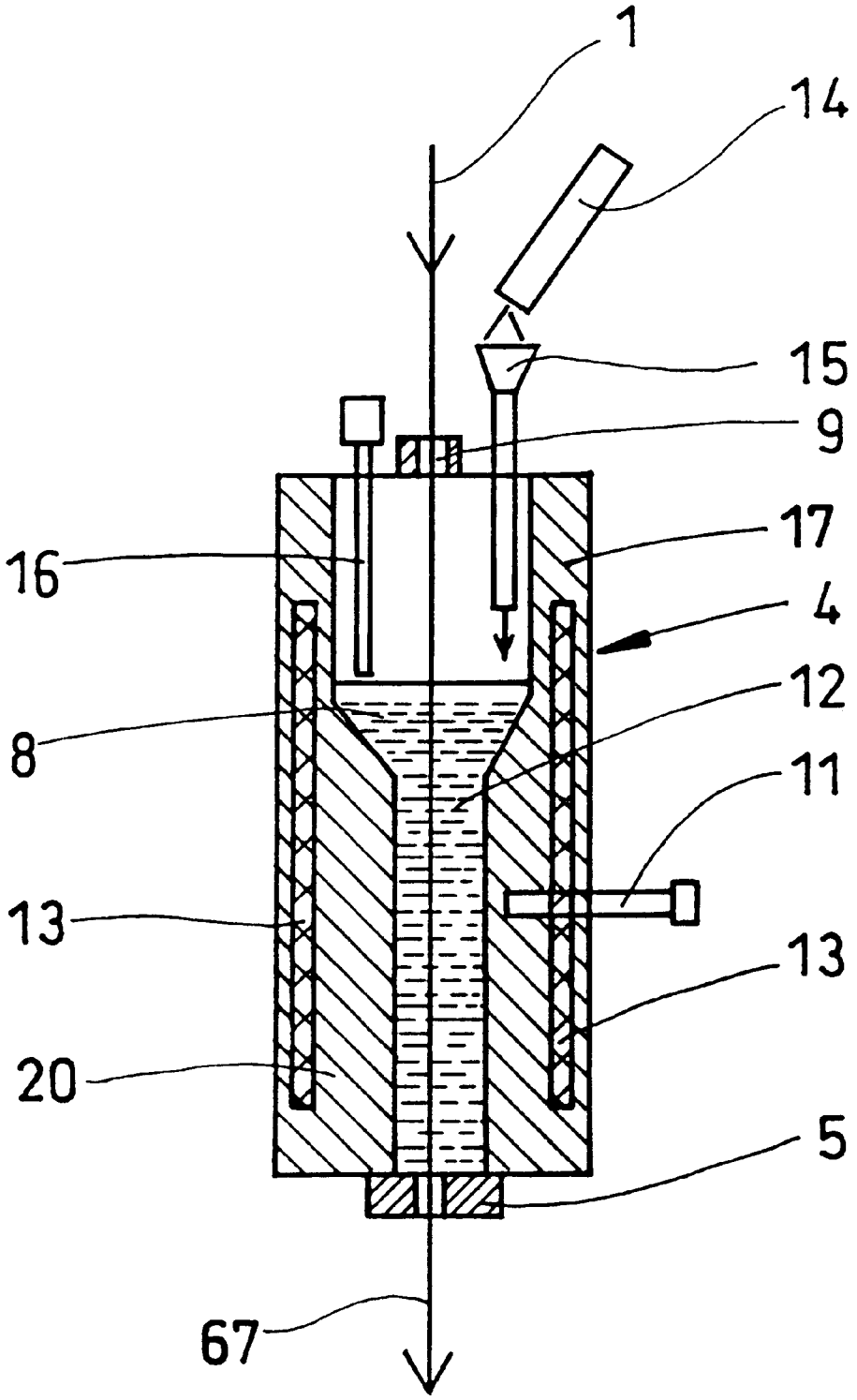
FIG. 3 is a cross-sectional view along line III—III in FIG. 2.

FIGS. 2 and 3 illustrate in greater detail for example a coating device 4 with a fusion chamber 8 for coating a bonding layer to an electrical conductor 1 with a layer of insulation, or to a number of electrical conductors each having a layer of insulation. In case of a number of electrical conductors, these may be twisted around each other or run parallel to each other. The fusion chamber 8 has an inlet opening 9 at one end for the one electrical conductor 1 for example. Electric connectors 10 are located in the circumference of the fusion chamber 8 and are used to supply current to electric heating elements 13 inserted into a jacket 17 surrounding the fusion chamber 8 in the coating device 4. The heating elements 13 heats the jacket 17 to create the temperature needed to melt a thermoplastic or thermosetting coating material in the fusion chamber 8. The control and adjustment of the temperature takes place with the help of a thermocouple 11 located in the jacket. 17. The fusion chamber 8 simultaneously forms a lengthwise coating chamber 12 through which the insulated electrical conductor 1 is drawn under ambient pressure for example, and in which the melted liquid coating material is located. This coating chamber 12 is surrounded by the jacket 17 of the fusion chamber 8 which is formed by a housing 20 of the coating device 4.

The thermoplastic or thermosetting coating material is delivered for example by a metering device 14 through an inlet funnel 15 located in an inlet opening of the fusion chamber 8. In the illustrated example, the metering device 14 has a sensor 16 which detects the fluid level of the melted thermoplastic or thermosetting material in the fusion chamber 8, and adjusts the supply of the material through the metering device 14, thereby controlling the fluid level to the predeterminable value which remains the same. The temperature of the melt depends on the specific melting temperature of the coating material being used and the necessary melting viscosity required to properly coat the insulated electrical conductor 1. The insulated electrical conductor 1 which passes vertically through the coating chamber 12 at the usual adjustable speed, which depends on the diameter and the power capacity of the coating device 4, leaves the calibration device 5 at the end of the coating chamber with a high degree of concentricity. The calibration device 5 has a drawing die made of hard metal, synthetic diamond known by the name of "Kompax" or natural diamond.

The thermoplastic or thermosetting coating material can be supplied to the fusion chamber 8 in powder form, as a granulate or as an endless strand. By adjusting the sensor 16 which extends for example into the fusion chamber 8 and is adjustable with respect to fluid level, the fluid level of the meltable coating material in the fusion chamber 8 can be controlled as a function of the diameter of the insulated electrical conductor 1, its passing speed through the coating device 4 and the coating material being used. In this way, the different fluid levels allow the pressure conditions to be varied as necessary in the fusion chamber 8, which simultaneously forms the coating chamber 12. A protective gas atmosphere can be provided in the fusion chamber 8 above the fluid surface of the melted thermoplastic or thermosetting material, to reduce the danger of contamination and undesirable chemical reactions.

Uncured thermoplastic polymers such as polyamide, thermoplastic polyester, polyetherketone (PEK, PEEK) or polyphenylketone are preferably used as coating materials. Particularly aliphatic polyamides with a melting temperature of 150° C. to 400° C. can be used, in that case preferably polyamides with a low water absorption such as PA 11 and PA 12. Beyond that other polyamides can also be used, such as aliphatic-aromatic, cyclo-aliphatic, aromatic polyamides and co-polyamides containing different types. Since these non-solvent-containing polyamides have a low melting viscosity, perfectly smooth and homogeneously meltable bonding layers can be produced for melt-bonding wires.

Figure 4:
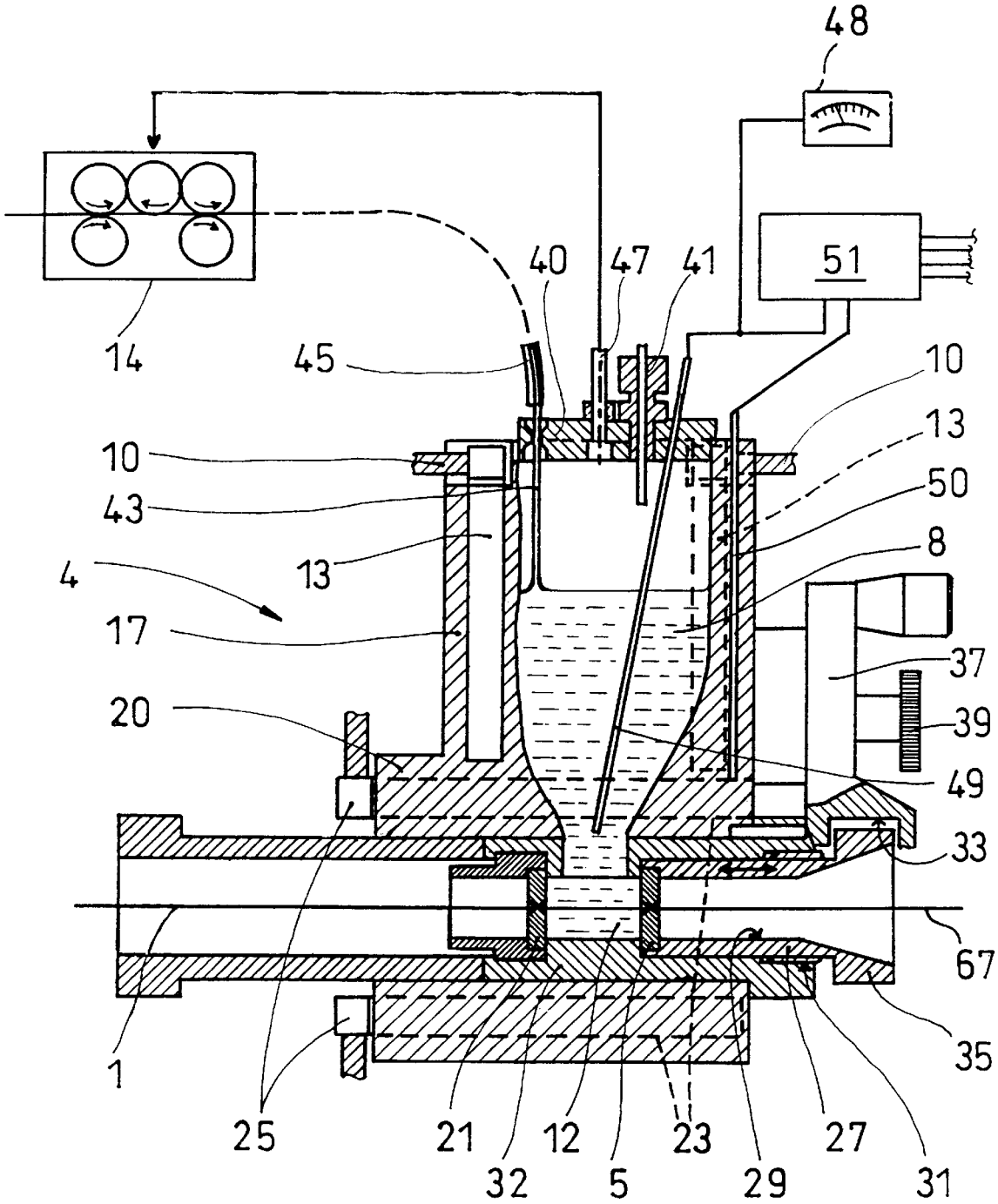
FIG. 4 is a cross-sectional view of a second embodiment of the coating device according to the invention.

The configuration example of a coating device 4 designed in accordance with the invention, which is illustrated in FIG. 4, essentially differs only from the configuration example in FIGS. 2 and 3 in that the electrical conductor 1 already equipped with a layer of insulation passes horizontally through the coating chamber 12. The coating chamber 12 is separated from the fusion chamber 8 which tapers like a funnel toward the coating chamber 12, and has an inlet nozzle 21 and a calibration device 5 formed by a second nozzle. Near the coating chamber 12, in parallel to the passing direction of the electrical conductor 1, the housing 20 is equipped for example with four electric heating elements 23 indicated by broken lines, with electric connectors 25, which provide a sufficiently high and uniform temperature of the melted thermoplastic or thermosetting material in the coating chamber 12 and in this way ensure a trouble-free coating of the insulated electrical conductor 1.

In order to achieve the most optimum quality and a sufficient and uniform thickness of the bonding layer placed on the insulated electrical conductor 1 in the coating chamber 12, it is advantageous if the size of the coating chamber 12 can be changed. To that end, a tube-shaped intermediate part 27 with the calibration device 5 located in its stepped lengthwise bore 29, can be unscrewed from a coating insert 32 in the coating device 4 in the direction of the arrow e.g. by means of a thread 31, or can be screwed into the coating insert 32 of the coating device 4. An adjustment part 37 with a suitable cutout 33 for a radial outward pointing flange 35 of the intermediate part 27 can be used to adjust the intermediate part 27 by means of an adjusting screw 39.

This configuration example has a gas connection 41 in a housing cover 40 above the melted thermoplastic or thermosetting material for supplying protective gas, such as nitrogen e.g., to the fusion chamber 8 in order to create a gas atmosphere above the melt to protect it against contamination and undesirable chemical reactions. In this case the thermoplastic or thermosetting coating material is supplied to the fusion chamber 8 as an endless strand 43 via a guide 45. An optical sensor 47 located e.g. in the housing cover 40 next to the gas connection 41 is used to detect the level of the liquid surface in the fusion chamber 8. This optical sensor 47 provides a signal to the metering device 14 which corresponds to the level of the liquid surface of the melted thermoplastic or thermosetting material, and is used to control the advance of the endless strand 43 and thereby control the supply of material to the fusion chamber 8. Unlike the illustration in FIG. 4, the optical sensor 47 can also be located in the fusion chamber 8, or protrude into same.

To monitor the temperatures in the fusion chamber 8 and in the jacket 17 of the housing 20, and to adjust the electric heating elements 13 and 23 accordingly, e.g. a temperature sensing device 49 with a temperature indicator 48 which protrudes into the melted coating material is provided in the fusion chamber 8 and a temperature sensor 50 located in the jacket 17 is provided e.g. parallel to the electric heating elements 13. The temperature sensor 50 and the temperature sensing device 49 provide respective signals to a temperature control 51 which is connected to the electric connectors 10 and 25 of the electric heating elements 13 and 23.

Figure 5:
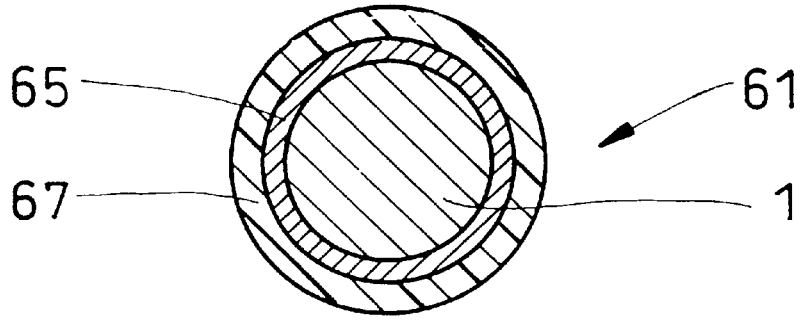
FIG. 5 is a cross-sectional view of a first embodiment of a melt-bonding wire made according to the invention.
Figure 6:
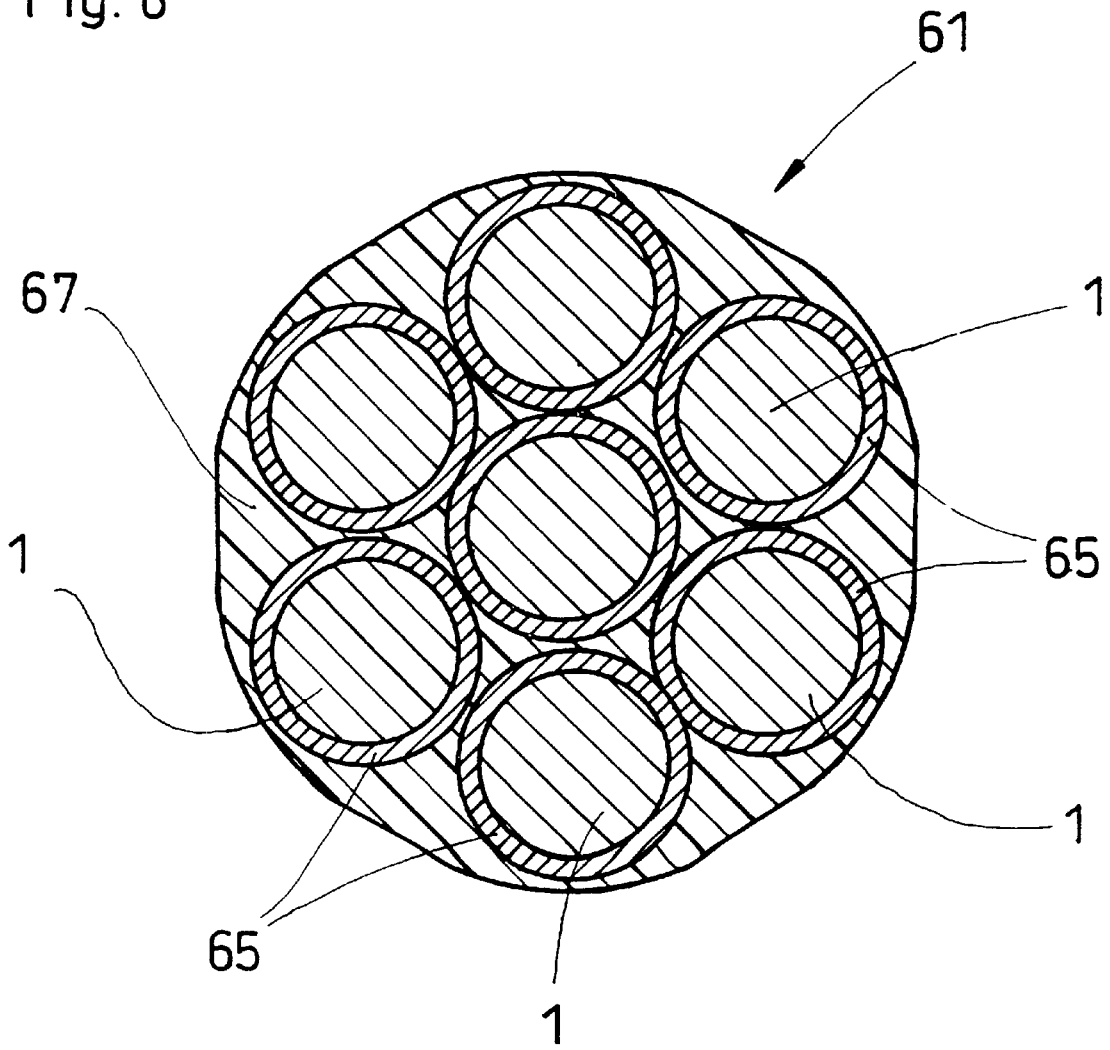
FIG. 6 is a cross-sectional view of a second example of a melt-bonding wire made according to the invention.

FIGS. 5 and 6 illustrate two examples of a melt-bonding wire 61 according to the invention. The melt-bonding wire 61 illustrated in FIG. 5 has an electrical conductor 1 which is surrounded by a layer of insulation made of insulating lacquer. A bonding layer of meltable thermoplastic or thermosetting material is applied over that, which is formed by passing the electrical conductor 1 with the layer of insulation 65 through a melted thermoplastic or thermosetting material.

A melt-bonding wire 61 with a number of electrical conductors 1 each of which is surrounded by its own layer of insulation 65 made of insulating lacquer, varnish or enamel is illustrated in FIG. 6. The insulated electrical conductors 1 are twisted around each other for example. But they can also be arranged to run parallel. A common bonding layer 67 made of a meltable thermoplastic or thermosetting material, which is applied by passing the insulated electrical conductors 1 through a melted thermoplastic or thermosetting material, envelops the electrical conductors 1, each of which is surrounded by a layer of insulation 65.

Due to the so-called skin effect such melt-bonding wires 61 containing several insulated electrical conductors 1 have better electric properties as compared to melt-bonding wires with only one insulated electrical conductor, which can positively be noticed in coils that operate at higher frequencies. This applies particularly to multi-wires where the individual insulated electrical conductors pass in parallel through the melted thermoplastic or thermosetting material to produce the common bonding layer.

The preferred embodiment described above admirably achieves the objects of the invention. However, it will be appreciated that departures can be made by those skilled in the art without departing from the spirit and scope of the invention which is limited only by the following claims.

What is claimed is:

1. A method of producing melt-bonding wires containing at least one electrical conductor, comprising the steps of:

(a) providing at least one electrical conductor having a layer of insulation thereon, the layer of insulation being selected from the group consisting of lacquer, varnish and enamel;

(b) supplying meltable plastic material to a fusion chamber where the meltable plastic material is melted to produce a melted plastic material, the meltable plastic material is selected from the group consisting of aliphatic, aliphatic-aromatic, cyclo-aliphatic and aromatic polyamides; aliphatic, aliphatic-aromatic, cyclo-aliphatic and aromatic co-polyamides; and aliphatic, aliphatic-aromatic, cyclo-aliphatic and aromatic polyesters with a melting temperature of 150° C. to 400° C. and are supplied in a form selected from the group consisting of powder, granular and strand, wherein the supplying step includes detecting a fluid level of the melted plastic material in the fusion chamber and adjusting the fluid level to a predeterminable value by metering the supply of the meltable plastic material to the fusion chamber;

(c) drawing the at least one electrical conductor having the layer of insulation through the melted plastic material to provide a calibrated meltable bonding layer thereon to thereby produce a melt-bonding wire; and (d) cooling the melt-bonding wire.

2. A method as claimed in claim 1, wherein, during the drawing step, the at least one electrical conductor with the layer of insulation thereon is drawn through the melted plastic material under ambient pressure.

3. A method as claimed in claim 1, further including the step of heating the at least one electrical conductor with the layer of insulation thereon before the bonding layer is applied.

4. A method as claimed in claim 1, wherein the drawing step includes the step of calibrating the bonding layer of the melt-bonding wire under the influence of heat.

5. A method as claimed in claim 1, wherein the meltable plastic material is selected from the group consisting of thermoplastic and thermosetting materials.

6. A method as claimed in claim 1, wherein the at least one conductor is several electrical conductors that each have a layer of insulation and are drawn through the melted plastic material together during the drawing step.

7. A method as claimed in claim 6, wherein the several electrical conductors are stranded.

8. A method as claimed in claim 6, wherein the several electrical conductors extend parallel to each other.

9. A method as claimed in claim 1, further including the step of providing a protective gas atmosphere in the fusion chamber above the melted plastic material.

* * * * *